US010574000B1

(12) United States Patent
McClinton

(10) Patent No.: US 10,574,000 B1
(45) Date of Patent: Feb. 25, 2020

(54) GROUNDING STRUCTURE FOR AN ELECTRICAL CONNECTOR

(71) Applicant: TE CONNECTIVITY CORPORATION, Berwyn, PA (US)

(72) Inventor: Jeffrey Byron McClinton, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/180,248

(22) Filed: Nov. 5, 2018

(51) Int. Cl.
*H01R 13/6587* (2011.01)
*H01R 13/6583* (2011.01)
*H01R 13/652* (2006.01)
*H01R 13/6471* (2011.01)

(52) U.S. Cl.
CPC ..... *H01R 13/6587* (2013.01); *H01R 13/6471* (2013.01); *H01R 13/652* (2013.01); *H01R 13/6583* (2013.01)

(58) Field of Classification Search
CPC ..... H01R 23/688; H01R 23/7073; H01R 13/65807; H01R 13/514; H01R 13/6587; H01R 13/6583; H01R 13/652; H01R 13/6471
USPC ..... 439/607.05–607.07
See application file for complete search history.

(56) References Cited

U.S. PATENT DOCUMENTS 5,620,340 A 4/1997 Andrews
6,347,962 B1 * 2/2002 Kline ..... H01R 13/514 439/181
6,520,803 B1 2/2003 Dunn
8,398,431 B1 * 3/2013 Whiteman, Jr. ... H01R 13/6587 439/607.06
8,398,432 B1 3/2013 McClellan et al.
8,475,209 B1 * 7/2013 Whiteman, Jr. ..... H01R 12/724 439/607.07
8,591,260 B2 11/2013 Davis
9,356,401 B1 5/2016 Horning et al.
9,407,045 B2 8/2016 Horning et al.
9,608,382 B2 3/2017 McClellan et al.
9,748,698 B1 8/2017 Morgan et al.
9,859,640 B1 * 1/2018 Horning ..... H01R 13/03
9,917,406 B1 * 3/2018 Iwasaki ..... H01R 13/6587
9,985,389 B1 5/2018 Morgan et al.
10,148,025 B1 12/2018 Trout et al.
10,186,811 B1 1/2019 Trout et al.
2003/0186594 A1 * 10/2003 Davis ..... H01R 23/688 439/701
2009/0227141 A1 * 9/2009 Pan ..... H01R 23/688 439/607.03

(Continued)

OTHER PUBLICATIONS

U.S. Appl. No. 16/180,199, filed Nov. 5, 2018.
U.S. Appl. No. 16/180,226, filed Nov. 5, 2018.

*Primary Examiner* — Gary F Paumen

(57) ABSTRACT

An electrical connector includes a front housing and a contact module received in a cavity of the front housing having a frame assembly including a dielectric holder holding signal contacts. Each signal contact has a mating end and a terminating end. A ground shield is coupled to the dielectric holder for shielding the signal contacts. The ground shield has a ground pad at the mating end, mating beams extending forward from the ground pad for mating with corresponding header ground shields and tie bars extending between corresponding mating beams.

20 Claims, 8 Drawing Sheets

(56) References Cited

U.S. PATENT DOCUMENTS

| | | | | |
|---|---|---|---|---|
| 2010/0144176 | A1* | 6/2010 | Fedder | H01R 13/514<br>439/108 |
| 2010/0227503 | A1* | 9/2010 | Liu | H01R 23/688<br>439/607.09 |
| 2014/0148054 | A1* | 5/2014 | Annis | H01R 13/514<br>439/607.05 |
| 2015/0303618 | A1* | 10/2015 | Lee | H01R 13/506<br>439/607.05 |
| 2018/0219329 | A1* | 8/2018 | Morgan | H01R 13/6585 |
| 2018/0219330 | A1* | 8/2018 | Morgan | H01R 13/6587 |

* cited by examiner

GROUNDING STRUCTURE FOR AN ELECTRICAL CONNECTOR

BACKGROUND OF THE INVENTION

The subject matter herein relates generally to grounding structures for electrical connector assemblies.

Electrical connector assemblies are used in communication systems for electrically connecting circuit boards. For example, some communication systems use header connector assemblies and receptacle connector assemblies to electrically connect circuit boards. Some known connector assemblies use differential pair signals along the signal paths that are electrically shielded within the connector assemblies. For example, the header connector assemblies utilize C-shaped header ground shields to provide electrical shielding for the pairs of signal contacts in the mating zone. However, at some frequencies, noise resonance is problematic at the mating interface between conventional connector assemblies.

A need remains for improved grounding structures for electrical connector assemblies.

BRIEF DESCRIPTION OF THE INVENTION

In one embodiment, an electrical connector is provided for mating with a header connector having header signal contacts and header ground shields providing electrical shielding for the header signal contacts. The electrical connector includes a front housing having a front and a rear and a cavity at the rear with the front configured to be mated with the header connector. The electrical connector includes a contact module received in the cavity having a frame assembly including an array of signal contacts and a dielectric holder holding the array of signal contacts. Each signal contact has a mating end and a terminating end. The mating end extends into the front housing for mating with the corresponding header signal contact of the header connector and the terminating end extends from the dielectric holder for termination to a circuit board. A ground shield is coupled to the dielectric holder. The ground shield provides electrical shielding for the signal contacts. The ground shield has a mating end and a terminating end configured to be terminated to the circuit board. The ground shield has a ground pad at the mating end, mating beams extending forward from the ground pad for mating with corresponding header ground shields and tie bars extending between corresponding mating beams.

In another embodiment, an electrical connector is provided for mating with a header connector having header signal contacts and header ground shields extending to tips providing electrical shielding for the header signal contacts. The electrical connector includes a front housing having a front and a rear and a cavity at the rear with the front configured to be mated with the header connector. The electrical connector includes a contact module received in the cavity having a frame assembly including an array of signal contacts and a dielectric holder holding the array of signal contacts. Each signal contact has a mating end and a terminating end. The mating end extends into the front housing for mating with the corresponding header signal contact of the header connector and the terminating end extends from the dielectric holder for termination to a circuit board. A ground shield is coupled to the dielectric holder. The ground shield provides electrical shielding for the signal contacts. The ground shield has a mating end and a terminating end configured to be terminated to the circuit board.

The ground shield has a ground pad at the mating end. The ground shield has mating beams extending forward from the ground pad to distal ends for mating with corresponding header ground shields forward of the tips of the corresponding header ground shields. The ground shield has tie bars extending between corresponding mating beams proximate to the distal ends. The tie bars are positioned forward of the tips of the corresponding header ground shields.

In a further embodiment, an electrical connector is provided for mating with a header connector having header signal contacts and header ground shields extending to tips providing electrical shielding for the header signal contacts. The electrical connector includes a front housing having a front and a rear and a cavity at the rear with the front configured to be mated with the header connector. The electrical connector includes a contact module received in the cavity having a frame assembly including an array of signal contacts and a dielectric holder holding the array of signal contacts. Each signal contact has a mating end and a terminating end. The mating end extends into the front housing for mating with the corresponding header signal contact of the header connector and the terminating end extends from the dielectric holder for termination to a circuit board. A ground shield is coupled to the dielectric holder. The ground shield provides electrical shielding for the signal contacts. The ground shield has a mating end and a terminating end configured to be terminated to the circuit board. The ground shield has a ground pad at the mating end. The ground shield has mating beams extending forward from the ground pad to distal ends for mating with corresponding header ground shields forward of the tips of the corresponding header ground shields. The ground shield has tie bars extending between corresponding mating beams. The tie bars define tie bar electrical paths between the mating beams independent of a ground pad electrical path defined between the mating beams by the ground pad and independent of electrical paths defined by the header ground shields.

DETAILED DESCRIPTION OF THE INVENTION

Figure 1:
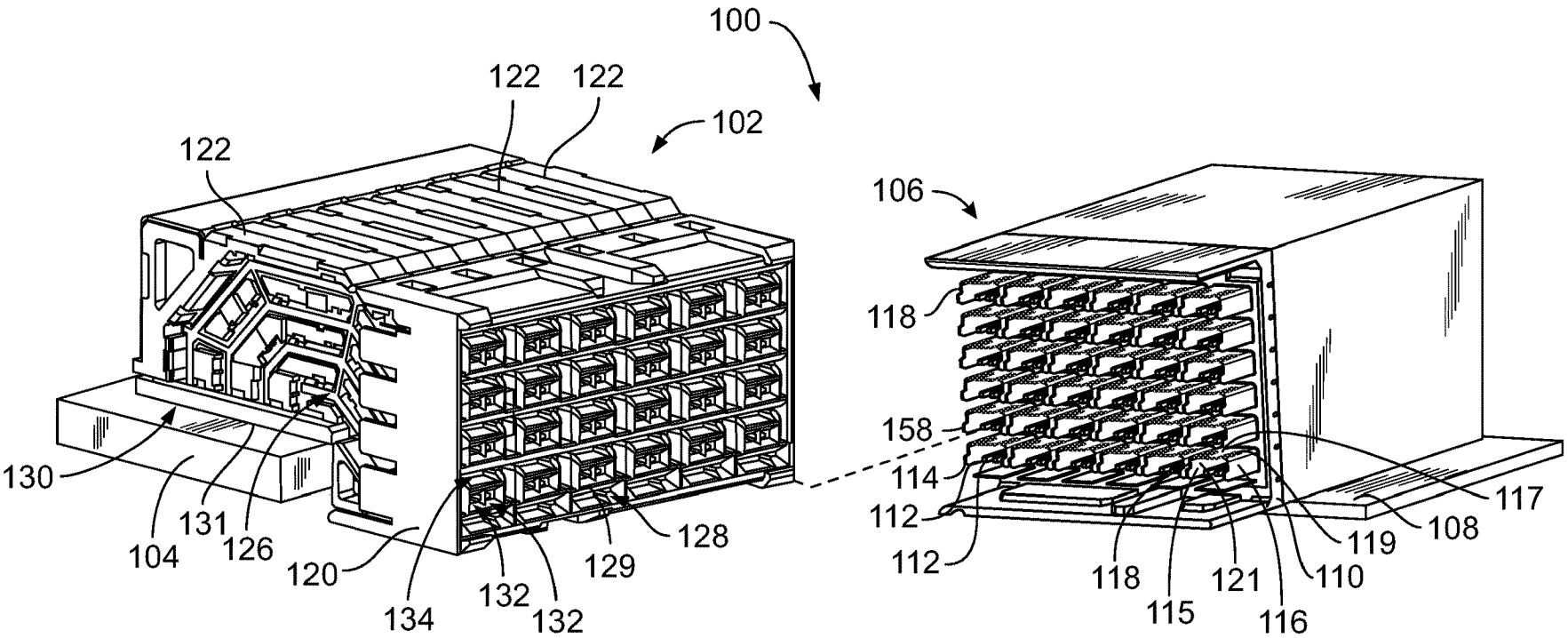
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes an electrical connector 102 configured to be mounted to a circuit board 104 and a mating electrical connector 106, which may be mounted to a circuit board 108. The mating electrical connector 106 may be a header connector and may be referred to hereinafter as a header connector 106. Various types of connector assemblies may be used in various embodiments, such as a right angle connector, a vertical connector or another type of connector.

The header connector 106 includes a housing 110 holding a plurality of header signal contacts 112 and header ground shields 114. The header signal contacts 112 may be arranged in pairs. Each header ground shield 114 extends around corresponding header signal contacts 112, for example, the pairs of header signal contacts 112. In the illustrated embodiment, the header ground shields 114 are C-shaped having three walls including end walls 115, 116 and a center wall 117 between the end walls 115, 116. The walls extend along three sides of each pair of header signal contacts 112. The header ground shield 114 adjacent to the pair provides electrical shielding along a fourth side of the pair. As such, the pairs of header signal contacts 112 are circumferentially surrounded on all four sides by the header ground shields 114. The header ground shields 114 may have other shapes in alternative embodiments. The header ground shields 114 extend to tips 118 at distal ends thereof. The center wall 117 has an interior surface 121 and slots 119 formed in the center wall 117, such as at the corners with the end walls 115, 116, open at the tips 118.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts 124 (shown in FIG. 2) that define signal paths through the electrical connector 102. The signal contacts 124 are configured to be electrically connected to corresponding header signal contacts 112 of the header connector 106.

The electrical connector 102 includes a mating end 128, such as at a front 129 of the electrical connector 102, and a mounting end 130, such as at a bottom 131 of the electrical connector 102. In the illustrated embodiment, the mounting end 130 is oriented substantially perpendicular to the mating end 128. The mating and mounting ends 128, 130 may be at different locations other than the front 129 and bottom 131 in alternative embodiments. The signal contacts 124 extend through the electrical connector 102 from the mating end 128 to the mounting end 130 for mounting to the circuit board 104.

The signal contacts 124 are received in the housing 120 and held therein at the mating end 128 for electrical termination to the header connector 106. The signal contacts 124 are arranged in a matrix of rows and columns. In the illustrated embodiment, at the mating end 128, the rows are oriented horizontally and the columns are oriented vertically. Other orientations are possible in alternative embodiments. Any number of signal contacts 124 may be provided in the rows and columns. Optionally, the signal contacts 124 may be arranged in pairs carrying differential signals; however other signal arrangements are possible in alternative embodiments, such as single-ended applications. Optionally, the pairs of signal contacts 124 may be arranged in rows (pair-in-row signal contacts); however, the pairs of signal contacts may be arranged in columns (pair-in-column signal contacts) in alternative embodiments. In an exemplary embodiment, the signal contacts 124 within each pair are contained within the same contact module 122.

In an exemplary embodiment, each contact module 122 has a shield structure 126 for providing electrical shielding for the signal contacts 124. The shield structure 126 is configured to be electrically connected to the header ground shields 114 of the header connector 106. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts 124. The contact modules 122 provide shielding for each pair of signal contacts 124 along substantially the entire length of the signal contacts 124 between the mating end 128 and the mounting end 130. In an exemplary embodiment, the shield structure 126 is configured to be electrically connected to the header connector 106 and/or the circuit board 104. The shield structure 126 may be electrically connected to the circuit board 104 by features, such as grounding pins and/or surface tabs.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding header signal contacts 112 of the header connector 106. In the illustrated embodiment, the ground contact openings 134 are C-shaped extending along three sides of the corresponding pair of signal contact openings 132. The ground contact openings 134 receive header ground shields 114 of the header connector 106. The ground contact openings 134 also receive portions of the shield structure 126 (for example, beams and/or fingers) of the contact modules 122 that mate with the header ground shields 114 to electrically common the shield structure 126 with the header connector 106.

The housing 120 is manufactured from a dielectric material, such as a plastic material, and provides isolation between the signal contact openings 132 and the ground contact openings 134. The housing 120 isolates the signal contacts 124 from the shield structure 126. The housing 120 isolates each set (for example, differential pair) of signal contacts 124 from other sets of signal contacts 124.

Figure 2:
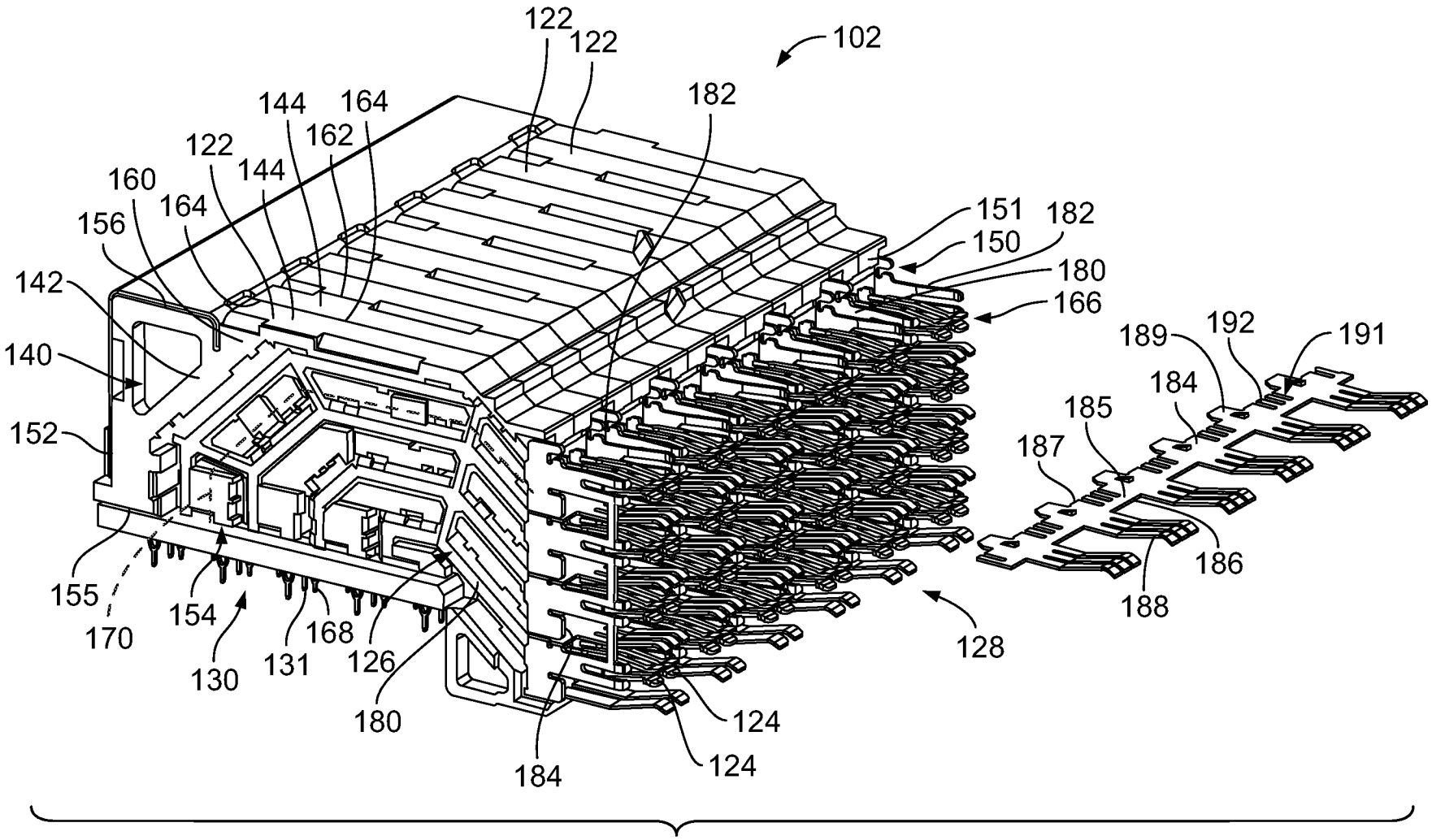
FIG. 2 is a partially exploded view of a portion of an electrical connector of the electrical connector system.

FIG. 2 is a partially exploded view of a portion of the electrical connector 102 with the housing 120 removed to illustrate the contact modules 122 in accordance with an exemplary embodiment. Each contact module 122 includes a frame assembly 140 having an array of the signal contacts 124 and a dielectric holder 142 holding the signal contacts 124. The dielectric holder 142 generally surrounds the signal contacts 124 along substantially the entire length of the signal contacts 124 between the mounting end 130 at the bottom 131 and the mating end 128 at the front 129. The shield structure 126 is coupled to the dielectric holder 142 to provide electrical shielding for the signal contacts 124, such as for each pair of the signal contacts 124. The shield structure 126 provides circumferential shielding for each pair of signal contacts 124 along at least a majority of a length of the signal contacts 124, such as substantially an entire length of the signal contacts 124.

In an exemplary embodiment, the frame assembly 140 is assembled together from two contact sub-assemblies. For example, the dielectric holder 142 may be a two-piece holder formed from two dielectric bodies 144 arranged side-by-side. Each dielectric body 144 surrounds a corresponding array of signal contacts 124. The dielectric body 144 may be overmolded over the signal contacts 124 (for example, each dielectric body 144 may be overmolded over a set of the signal contacts 124 to form one of the contact sub-assemblies). Optionally, the signal contacts 124 may be initially formed from a leadframe and overmolded by the corresponding dielectric body 144 such that portions of the signal contacts 124 are encased in the dielectric holder 142.

The dielectric holder 142 has a mating end 150 at a front 151 thereof configured to be loaded into the housing 120 (shown in FIG. 1), a rear 152 opposite the mating end 150, a mounting end 154 at a bottom 155 which optionally may be adjacent to the circuit board 104 (shown in FIG. 1), and a top 156 generally opposite the mounting end 154. The dielectric holder 142 also includes first and second sides, such as a right side 160 and a left side 162. The shield structure 126 is coupled to both the right and left sides 160, 162. The dielectric bodies 144 include respective interior sides 164 facing and abutting each other. Each dielectric body 144 holds one of the signal contacts 124 from each pair such that the pair has signal contacts 124 in both contact sub-assemblies. When assembled, the signal contacts 124 in each pair are aligned with each other and follow similar paths between the mating and mounting ends 128, 130. For example, the signal contacts 124 have similar shapes and thus have similar lengths, which reduces or eliminates skew in the signal paths for the pairs. The pair-in-row arrangement may enhance the electrical performance of the contact module 122 as compared to pair-in-column contact modules having the signal contacts of each pair radially offset from each other (for example, one radially inside and the other radially outside), leading to skew problems.

The signal contacts 124 may be stamped and formed from a sheet of metal material. Each signal contact 124 has a mating portion 166 extending forward from the mating end 150 of the dielectric holder 142 and a mounting portion 168 extending downward from the mounting end 154. The mating and mounting portions 166, 168 are exposed beyond the front 151 and the bottom 155, respectively, of the dielectric holder 142. Each signal contact 124 has a transition portion 170 (one of which is shown in phantom in FIG. 2) between the mating and mounting portions 166, 168. The transition portions 170 each include a top, a bottom, a right side, and a left side (the right and left sides define corresponding inner and outer sides for the left and right contact sub-assemblies. In an exemplary embodiment, the top, bottom, and corresponding outer side are each configured to be shielded by the shield structure 126. The inner sides (right side or left side) face each other along the lengths of the transition portions 170. The mating portions 166 are configured to be electrically terminated to corresponding header signal contacts 112 (shown in FIG. 1) when the electrical connector 102 is mated to the header connector 106 (shown in FIG. 1). In an exemplary embodiment, the mounting portions 168 include compliant pins, such as eye-of-the-needle pins, configured to be terminated to the circuit board 104 (shown in FIG. 1).

In an exemplary embodiment, the shield structure 126 includes first and second ground shields 180, 182 and ground blades 184 extending between and configured to be electrically connected to the first and second ground shields 180, 182. Each ground blade 184 is configured to be assembled with the dielectric holder 142, such as immediately forward of the mating end 150 of the dielectric holder 142. The ground blade 184 may be attached to the dielectric holder 142 at the mating end 150. In an exemplary embodiment, the ground blades 184 span or cover the mating ends 150 of each of the dielectric holders 142. The ground blades 184 are oriented horizontally along the front 129 of the electrical connector 102. The ground blades 184 are positioned adjacent to the mating zone between the signal contacts 124 and the header signal contacts 112 (FIG. 1). The ground blades 184 are configured to be electrically connected to the first and second ground shields 180, 182 of each contact module 122 such that the ground shields 180, 182 are electrically commoned adjacent to the mating zone. Optionally, the ground blades 184 may be used to mechanically secure the first ground shield 180 and/or the second ground shield 182 to the contact module 122. The ground blades 184 provide electrical shielding for the signal contacts 124 at the exit/entrance points of the signal contacts 124 from the dielectric holder 142. The ground blades 184 provide electrical shielding for the mating portions 166 of the signal contacts 124 adjacent to the mating zone.

In an exemplary embodiment, the ground blades 184 are provided above and/or below each of the mating portions 166 of the pairs of signal contacts 124 to provide electrical shielding between the pairs of signal contacts 124 within the same contact module 122. The first and second ground shields 180, 182 are provided along right and left sides of each of the mating portions 166 of the pairs of signal contacts 124 to provide electrical shielding between the pairs of signal contacts 124 in adjacent contact modules 122. In an exemplary embodiment, the ground blades 184 and the first and second ground shields 180, 182 form shield pockets around each pair of signal contacts 124 to shield such pair from adjacent pairs in the same column and in the same row. In an exemplary embodiment, the ground blades 184 and the first and second ground shields 180, 182 extend across the fronts 151 of the dielectric holders 142 to provide shielding for the mating portions 166 and the transition portions 170 of the signal contacts 124.

The first and second ground shields 180, 182 cooperate to provide circumferential shielding for each pair of signal contacts 124 along the length thereof. The first ground shield 180 is positioned along the right side 160 of the dielectric holder 142, and as such, may be hereinafter referred to as the right ground shield 180. The second ground shield 182 is positioned along the left side 162 of the dielectric holder 142, and may be hereinafter referred to as the left ground shield 182. The first and second ground shields 180, 182 and the ground blades 184 electrically connect the contact module 122 to the header connector 106, such as to the header ground shields 114 thereof (shown in FIG. 1), thereby providing an electrically common ground path between the electrical connector 102 and the header connector 106. The first and second ground shields 180, 182 electrically connect the contact module 122 to the circuit board 104, such as through compliant pins thereof. The first and second ground shields 180, 182 may be similar and include similar features and components. As such, the description below may include description of either ground shield, which may be relevant to the other ground shield, and like components may be identified with like reference numerals.

In an exemplary embodiment, the ground blade 184 includes a main body 185 having a front 186 and a rear 187. The ground blade 184 includes a plurality of mating portions 188 extending forward from the front 186. In the illustrated embodiment, the mating portions 188 are arranged in sets, with each set configured to mate with a corresponding header ground shield 114 (shown in FIG. 1). Each set includes a plurality of mating portions 188, thus defining multiple points of contact with the header ground shield 114. Other arrangements are possible in alternative embodiments, such as having multiple mating portions 188. The mating portions 188 are deflectable mating beams configured to be spring biased against the header ground shield 114 when mated thereto to create a mechanical and electrical connection with the header ground shield 114. Optionally, the mating portions 188 are configured to be received inside the corresponding C-shaped header ground shields 114 of the header connector 106. Alternatively, the mating portions 188 are configured to extend along the outside of the corresponding C-shaped header ground shields 114 of the header connector.

The ground blade 184 includes a mounting tab 189 extending from the rear 187. The mounting tab 189 is used for mounting the ground blade 184 to the dielectric holder 142 (shown in FIG. 2). The ground blade 184 includes slots 191 that receive the first and second ground shields 180, 182 during mating thereto. In an exemplary embodiment, the ground blade 184 includes a mating finger 192 extending along the slot 191. The mating finger 192 is configured to be mated to the corresponding ground shield 180, 182. Optionally, the mating finger 192 may be deflectable.

Figure 3:
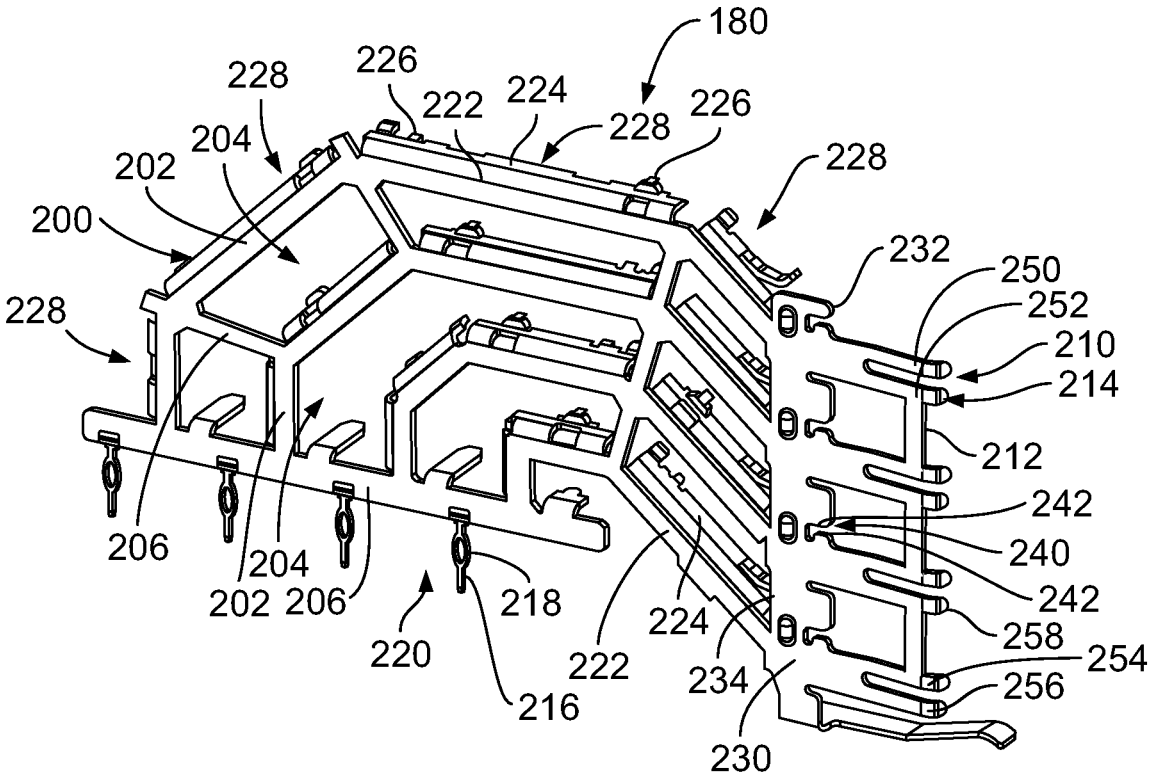
FIG. 3 is a perspective view of a ground shield of the electrical connector in accordance with an exemplary embodiment.

FIG. 3 is a perspective view of the first ground shield 180 in accordance with an exemplary embodiment. In an exemplary embodiment, the first ground shield 180 is stamped and formed from a stock piece of metal material. The first ground shield 180 includes a main body 200 configured to extend along the right side 160 of the dielectric holder 142 (both shown in FIG. 2). The main body 200 includes a plurality of right side rails 202 separated by right side gaps 204. The right side rails 202 are interconnected by struts 206 that span the gaps 204 between the right side rails 202.

The first ground shield 180 includes mating beams 210 at a mating end 214 of the main body 200. In an exemplary embodiment, the mating beams 210 are tied together physically and electrically by tie bars 212. The mating beams 210 are configured to be mated with corresponding mating portions of the header connector 106 (for example, the C-shaped header ground shields 114, shown in FIG. 1). In an exemplary embodiment, the mating beams 210 are bifurcated including multiple mating beams 210 associated with each corresponding signal contact 124. The mating beams 210 may be deflectable mating beams, such as spring beams. Optionally, the mating beams 210 are configured to be received inside the corresponding C-shaped header ground shields 114 of the header connector 106. Alternatively, the mating beams 210 are configured to extend along the outside of the corresponding C-shaped header ground shields 114 of the header connector.

The first ground shield 180 includes mounting portions 216 defined by compliant pins 218 at a mounting end 220 of the main body 200. The mounting portions 216 are configured to be terminated to the circuit board 104 (shown in FIG. 1). For example, the mounting portions 216 are configured to be received in plated vias in the circuit board 104.

The right side rails 202 are configured to provide shielding around corresponding signal contacts 124 (shown in FIG. 2). For example, in an exemplary embodiment, the right side rails 202 have side strips 222 configured to extend along the right side 160 of the dielectric holder 142, and connecting strips 224 configured to extend into the dielectric holder 142 and extend between adjacent signal contacts 124. The connecting strips 224 are bent perpendicular to and extend from the corresponding side strips 222. The right side rails 202 form right angle shielded spaces that receive corresponding signal contacts 124 to provide electrical shielding along the sides of the signal contacts 124 and between the signal contacts 124, such as above and/or below corresponding signal contacts 124. The struts 206 interconnect the right side rails 202 to hold the relative positions of the right side rails 202. The gaps 204 are defined between the right side rails 202 and generally follow the paths of the right side rails 202.

In an exemplary embodiment, each connecting strip 224 includes a commoning feature 226 for electrically connecting to the second ground shield 182 (shown in FIG. 2). In the illustrated embodiment, the commoning features 226 are commoning tabs that extend outward from the connecting strips 224 and commoning slots; however, other types of commoning features may be used in alternative embodiments, such as channels, spring beams, and the like. The commoning features 226 may be deflectable to engage and securely couple the first ground shield 180 to the second ground shield 182 when mated thereto. For example, the commoning features 226 may be clips.

The right side rails 202 are configured to extend along and follow the paths of the signal contacts 124, such as between the mating end 128 and the mounting end 130 (both shown in FIG. 1) of the electrical connector 102. For example, the right side rails 202 may transition from the mating end 214 to the mounting end 220 and have different segments or portions 228 that are angled relative to each other as the right side rails 202 transition between the mating and mounting ends 214, 220.

In an exemplary embodiment, the first ground shield 180 includes a first ground pad 230 at the mating end 214 forward of the right side rails 202. The mating beams 210 extend from the first ground pad 230. The first ground pad 230 is continuous top to bottom and holds the positions of the right side rails 202 and the mating beams 210. The first ground pad 230 forms continuous shielding along the right sides of the signal contacts 124. The first ground pad 230 extends between a front 232 and a rear 234. The mating beams 210 extend forward from the front 232. The right side rails 202 extend from the rear 234. Optionally, the first ground pad 230 may be out of plane with the right side rails 202, such as outward of the side strips 222 and the connecting strips 224.

The first ground pad 230 includes slots 240 having guide features 242. The slots 240 receive corresponding ground blades 184 (shown in FIG. 2). The guide features 242 engage the ground blades 184 to locate the ground blades 184 relative to the first ground shield 180. For example, the guide features 242 may be vertically positioned in the ground blade 184 in the slot 240. The guide features 242 may support the ground blades 184 in the slot 240.

The first ground shield 180 includes the tie bars 212 between the mating beams 210 forward of the first ground pad 230. In an exemplary embodiment, the tie bars 212 are integral with the first mating beams 210 as part of the first ground shield 180. For example, the first ground shield 180 is an integral, unitary monolithic body forming the first ground pad 230, the first mating beams 210 and the tie bars 212. The tie bars 212 and the first mating beams 210 are electrically commoned with each other and the tie bars 212 define another electrical path between the header ground shields 114 in addition to the first ground pad 230. The mating beams 210 and the tie bars 212 are configured to be electrically commoned with each of the header ground shields 114.

The tie bars 212 extend between corresponding first mating beams 210. Optionally, the tie bars 212 may be directly mated with and electrically connected to corresponding header ground shields 114. In other various embodiments, the tie bars 212 are indirectly electrically connected to the header ground shields 114 through the first mating beams 210. The first ground pad 230 ties each of the first mating beams 210 together to physically hold positions of each of the first mating beams 210 relative to each other. The tie bars 212 tie each of the first mating beams 210 together to physically hold positions of the distal ends of the first mating beams 210 relative to each other.

In an exemplary embodiment, the mating beams 210 are arranged in sets including an upper beam member 250 and a lower beam member 252. For example, the mating beam 210 is bifurcated to form the upper beam member 250 and the lower beam member 252. The upper and lower beam members 250, 252 are independently movable relative to each other. The upper beam members 250 each include a corresponding mating interface 254 defining a point of contact with the corresponding header ground shield 114. The lower beam members 252 each include a corresponding mating interface 256 define a point of contact with the corresponding header ground shield 114. The upper and lower beam members 250, 252 of the same mating beam 210 are configured to engage the same header ground shield 114. In an exemplary embodiment, the tie bars 212 extend between an upper beam member 250 of one mating beam 210 and the lower beam member 252 of a different mating beam 210. The tie bars 212 are independently movable relative to each other, such as with the corresponding beam members 250, 252. In an exemplary embodiment, the tie bars 212 are located proximate to the mating interfaces 254, 256. For example, the tie bars 212 may be located proximate to distal ends 258 of the mating beams 210.

Figure 4:
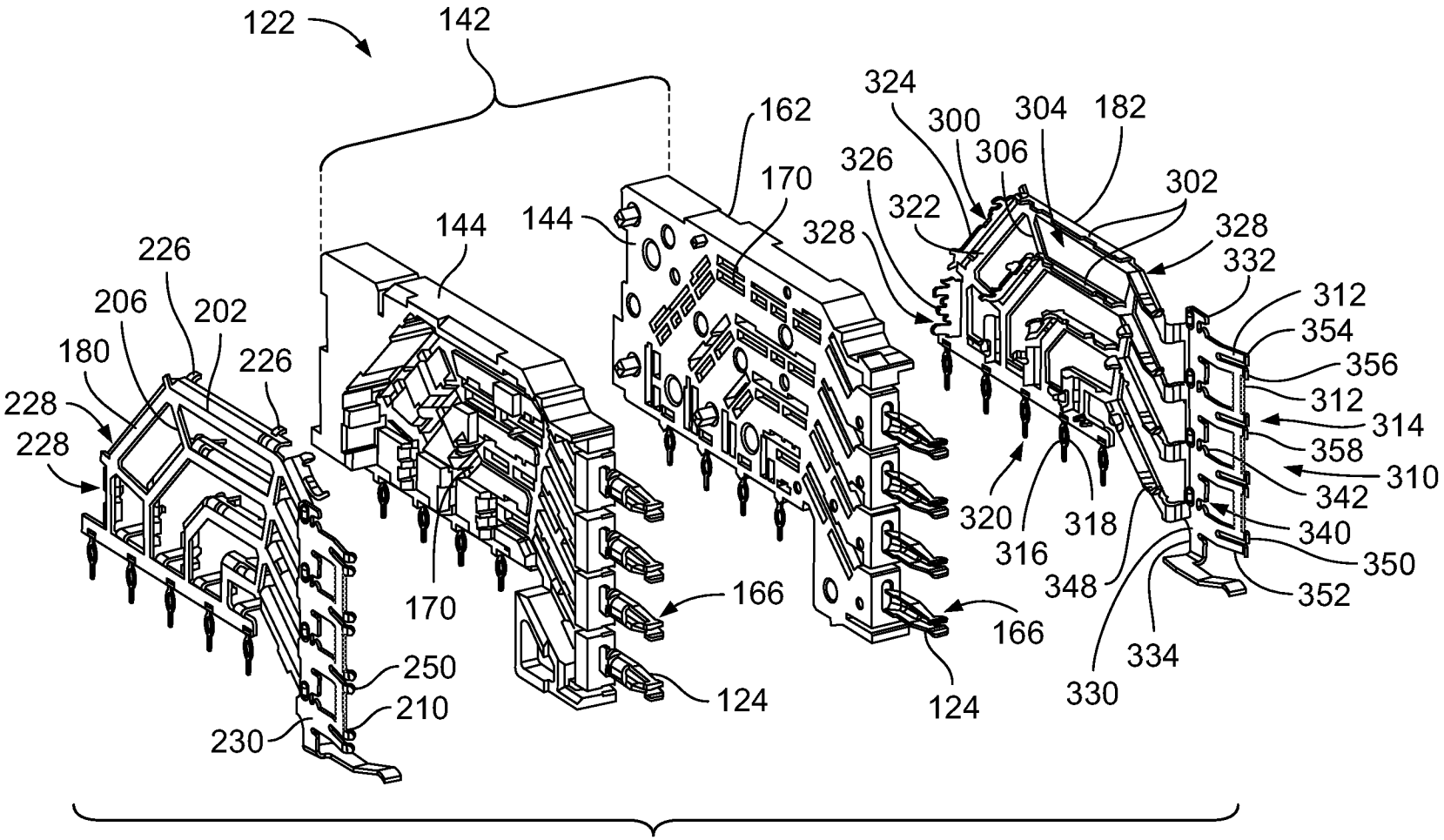
FIG. 4 is an exploded view of a contact module of the electrical connector in accordance with an exemplary embodiment.

FIG. 4 is an exploded view of the contact module 122 showing the first and second ground shields 180, 182 relative to the dielectric bodies 144 of the dielectric holder 142. The second ground shield 182 may be similar to the first ground shield 180. In an exemplary embodiment, the second ground shield 182 is stamped and formed from a stock piece of metal material. The second ground shield 182 includes a main body 300 configured to extend along the left side 162 of the dielectric holder 142. The main body 300 includes a plurality of left side rails 302 separated by gaps 304. The left side rails 302 are interconnected by struts 306 that span the gaps 304 between the rails 302.

The second ground shield 182 includes mating beams 310 at a mating end 314 of the main body 300. In an exemplary embodiment, the mating beams 310 are tied together physically and electrically by tie bars 312. The mating beams 310 are configured to be mated with corresponding mating portions of the header connector (for example, the C-shaped header ground shields 114, shown in FIG. 1). In an exemplary embodiment, the mating beams 310 extend along the left sides of the corresponding signal contacts 124. The mating beams 310 may be deflectable mating beams, such as spring beams. Optionally, the mating beams 310 are configured to be received inside the corresponding C-shaped header ground shields 114 of the header connector 106. Alternatively, the mating beams 310 are configured to extend along the outside of the corresponding C-shaped header ground shields 114 of the header connector.

The second ground shield 182 includes mounting portions 316 defined by compliant pins 318 at a mounting end 320 of the main body 300. The mounting portions 316 are configured to be terminated to the circuit board 104 (shown in FIG. 1). For example, the mounting portions 316 are configured to be received in plated vias in the circuit board 104.

The left side rails 302 are configured to provide shielding around corresponding signal contacts 124 (shown in FIG. 2). For example, in an exemplary embodiment, the left side rails 302 have side strips 322 configured to extend along the left side 162 of the dielectric holder 142, and connecting strips 324 configured to extend into the dielectric holder 142 and extend between adjacent signal contacts 124. The connecting strips 324 are bent perpendicular to and extend from the corresponding side strips 322. The left side rails 302 form right angle shielded spaces that receive corresponding signal contacts 124 to provide electrical shielding along the sides of the signal contacts 124 and between the signal contacts 124, such as above and/or below corresponding signal contacts 124. The struts 306 interconnect the left side rails 302 to hold the relative positions of the left side rails 302. The gaps 304 are defined between the left side rails 302 and generally follow the paths of the left side rails 302.

In an exemplary embodiment, each connecting strip 324 includes a commoning feature 326 for electrically connecting to the first ground shield 180 (shown in FIG. 3). In the illustrated embodiment, the commoning features 326 are commoning slots in the connecting strips 324 and commoning tabs; however, other types of commoning features may be used in alternative embodiments, such as channels, spring beams, clips, and the like. The commoning features 326 may be deflectable to engage and securely couple the second ground shield 182 to the first ground shield 180 when mated thereto.

The left side rails 302 are configured to extend along and follow the paths of the signal contacts 124, such as between the mating end 128 and the mounting end 130 (both shown in FIG. 1) of the electrical connector 102. For example, the left side rails 302 may transition from the mating end 314 to the mounting end 320 and have different segments or portions 328 that are angled relative to each other as the left side rails 302 transition between the ends 314, 320.

In an exemplary embodiment, each rail 202, 302 includes multiple commoning features 226, 326 to make periodic, reliable electrical connections therebetween. For example, each portion 228, 328 may include at least one commoning feature 226, 326. The commoning features 226, 326 may be generally spaced at approximately 3-5 mm apart to achieve good electrical performance in a desired range, such as between 30-40 GHz; however other spacings or other target ranges may be achieved in other embodiments.

When assembled, the ground shields 180, 182 form C-shaped hoods covering three sides of each pair of signal contacts 124. For example, the hoods cover both the right and left sides as well as the tops of the signal contacts 124 to shield the pair of signal contacts 124 from other pairs of signal contacts 124. The rails 202, 302 below the pair of signal contacts 124 shield the fourth side of the pair of signal contacts 124 such that the pair is shielded on all four sides. The first and second ground shields 180, 182 thus provide circumferential shielding around the pairs of signal contacts 124. The circumferential shielding is provided around each pair of signal contacts 124 for substantially the entire length of the transition portions 170 (shown in FIG. 2) of the signal contacts. The first and second ground shields 180, 182 provide shielding in all line-of-sight directions between all adjacent pairs of signal contacts 124, including pairs of signal contacts 124 in adjacent contact modules 122. Optionally, the bottom of the inner-most pair remains unshielded; however, the signal performance of the signal contacts 124 of the inner-most pair remains largely unaffected by having the one side unshielded. Optionally, a shield may be provided at the unshielded side of the innermost pair.

In an exemplary embodiment, the second ground shield 182 includes a second ground pad 330 forward of the left side rails 302. The mating beams 310 extend from the second ground pad 330. The second ground pad 330 is continuous top to bottom and holds the positions of the left side rails 302 with the struts 306. The second ground pad 330 forms continuous shielding along the left sides of the signal contacts 124. The second ground pad 330 extends between a front 332 and a rear 334. The mounting portions 316 extend forward from the front 332. The left side rails 302 extend from the rear 334. Optionally, the second ground pad 330 may be out of plane with the left side rails 302, such as outward of the side strips 322 and the connecting strips 324.

The second ground pad 330 includes slots 340 having guide features 342. The slots 340 receive corresponding ground blades 184 (shown in FIG. 2). The guide features 342 engage the ground blades 184 to locate the ground blades 184 relative to the first ground shield 182. For example, the guide features 342 may be vertically positioned in the ground blade 184 in the slot 340. The guide features 342 may support the ground plates 184 in the slot 340.

The second ground shield 180 includes the tie bars 312 between the mating beams 310 forward of the second ground pad 330. In an exemplary embodiment, the tie bars 312 are integral with the second mating beams 310 as part of the second ground shield 180. For example, the second ground shield 180 is an integral, unitary monolithic body forming the second ground pad 330, the second mating beams 310 and the tie bars 312. The tie bars 312 and the second mating beams 310 are electrically commoned with each other and the tie bars 312 define another electrical path between the header ground shields 114 in addition to the second ground pad 330. The mating beams 310 and the tie bars 312 are configured to be electrically commoned with each of the header ground shields 114.

The tie bars 312 extend between corresponding second mating beams 310. Optionally, the tie bars 312 may be directly mated with and electrically connected to corresponding header ground shields 114. In other various embodiments, the tie bars 312 are indirectly electrically connected to the header ground shields 114 through the second mating beams 310. The second ground pad 330 ties each of the second mating beams 310 together to physically hold positions of each of the second mating beams 310 relative to each other. The tie bars 312 tie each of the second mating beams 310 together to physically hold positions of the distal ends of the second mating beams 310 relative to each other.

In an exemplary embodiment, the mating beams 310 are arranged in sets including an upper beam member 350 and a lower beam member 352. For example, the mating beam 310 is bifurcated to form the upper beam member 350 and the lower beam member 352. The upper and lower beam members 350, 352 are independently movable relative to each other. The upper beam members 350 each include a corresponding mating interface 354 defining a point of contact with the corresponding header ground shield 114. The lower beam members 352 each include a corresponding mating interface 356 define a point of contact with the corresponding header ground shield 114. The upper and lower beam members 350, 352 of the same mating beam 310 are configured to engage the same header ground shield 114. In an exemplary embodiment, the tie bars 312 extend between an upper beam member 350 of one mating beam 310 and the lower beam member 352 of a different mating beam 310. The tie bars 312 are independently movable relative to each other, such as with the corresponding beam members 350, 352. In an exemplary embodiment, the tie bars 312 are located proximate to the mating interfaces 354, 356. For example, the tie bars 312 may be located proximate to distal ends 358 of the mating beams 310.

Figure 5:
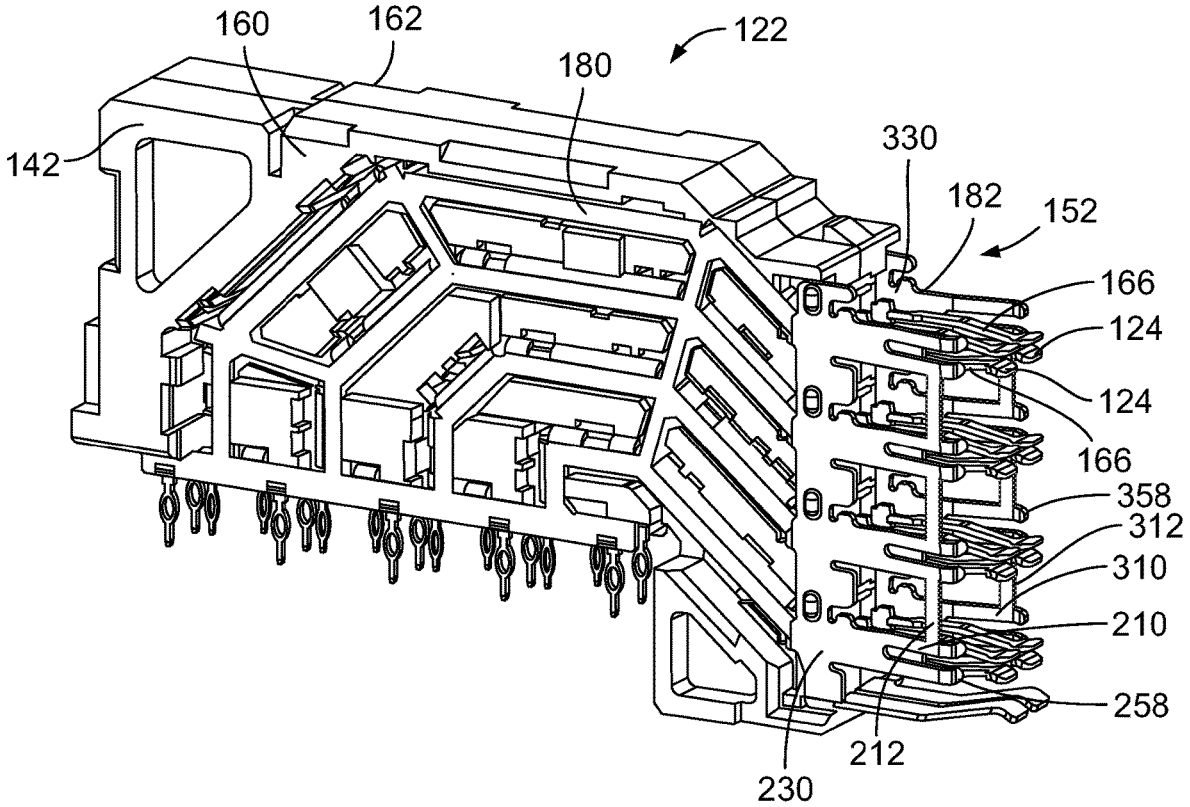
FIG. 5 is a perspective view of the contact module in an assembled state.

FIG. 5 is a perspective view of the contact module 122 in an assembled state showing the first and second ground shields 180, 182 coupled to the dielectric holder 142. The first and second ground shields 180, 182 are received in channels in the dielectric holder 142. The first and second ground pads 230, 330 are located along the right and left sides of the dielectric holder 142 at the mating end 150. Portions of the first and second ground pads 230, 330 extend along the right and left sides 160, 162, respectively. The tie bars 212, 312 extend between the mating beams 210, 310 and are located forward of the mating end 150 along the mating portions 166 of the signal contacts 124. The first and second ground pads 230, 330 form continuous shield walls from the top to the bottom of the contact module 122 forward of the mating end 150. The continuous shield walls provide electrical shielding for the mating portions 166 where the mating portions 166 extend from the mating end 150 of the dielectric holder 142. The mating beams 210, 310 of the first and second ground shields 180, 182 extend forward of the first and second ground pads 230, 330 along the mating portions 166 of the signal contacts 124 to make electrical connection with the header ground shield 114 (shown in FIG. 1). The tie bars 212, 312 define electrical paths between the mating beams 210, 312, respectively to create a ground path between the mating beams 210, 310 and electrically common the mating beams 210, 310, such as proximate to the distal ends 258, 358 of the mating beams 210, 310.

Figure 6:
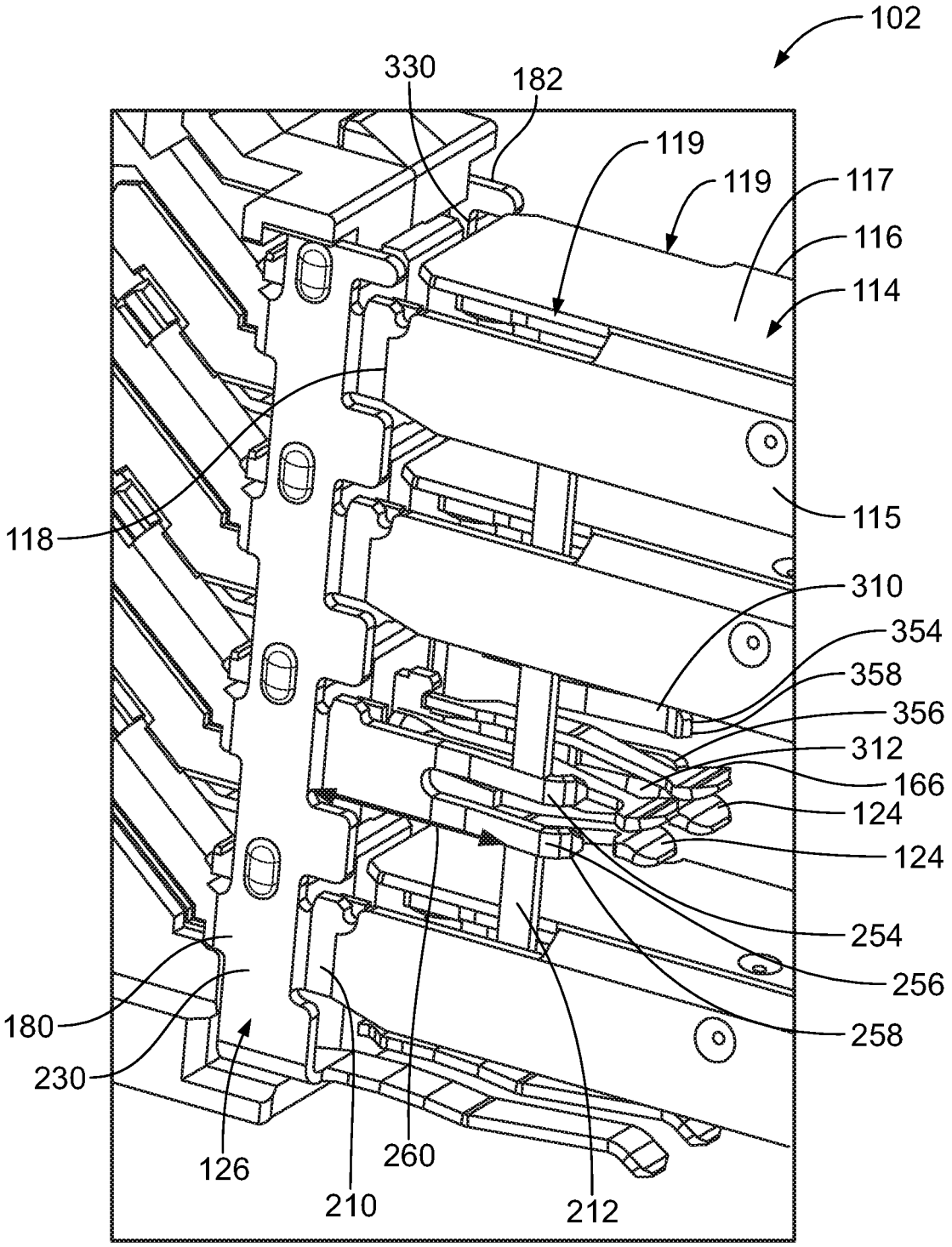
FIG. 6 is a perspective view of a portion of the electrical connector in accordance with an exemplary embodiment.
Figure 7:
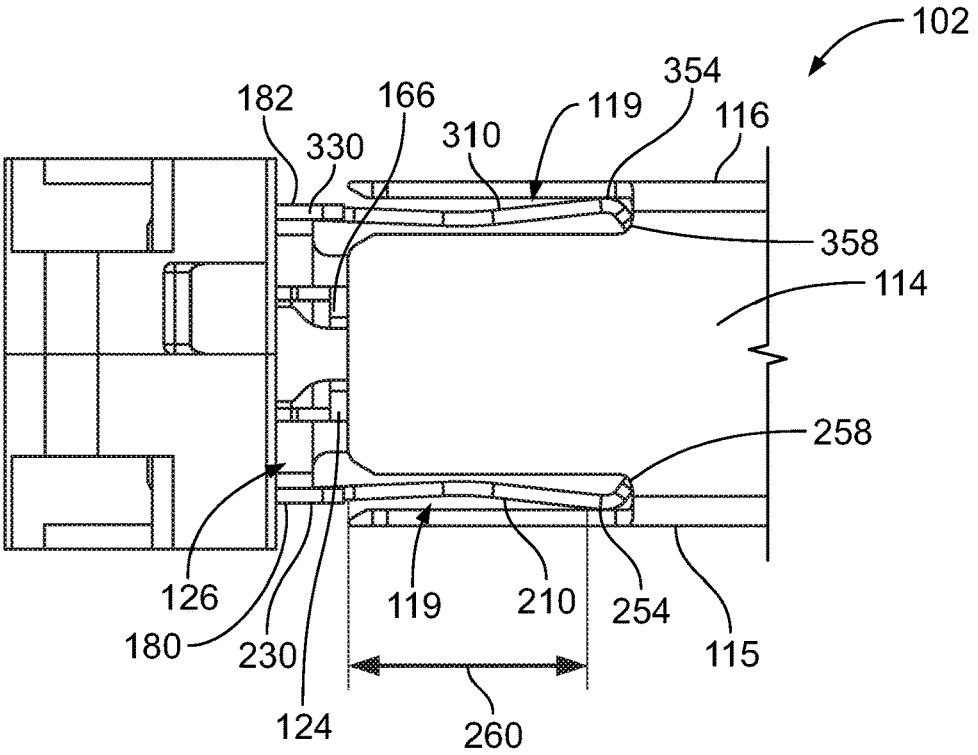
FIG. 7 is a top view of a portion of the electrical connector in accordance with an exemplary embodiment.
Figure 8:
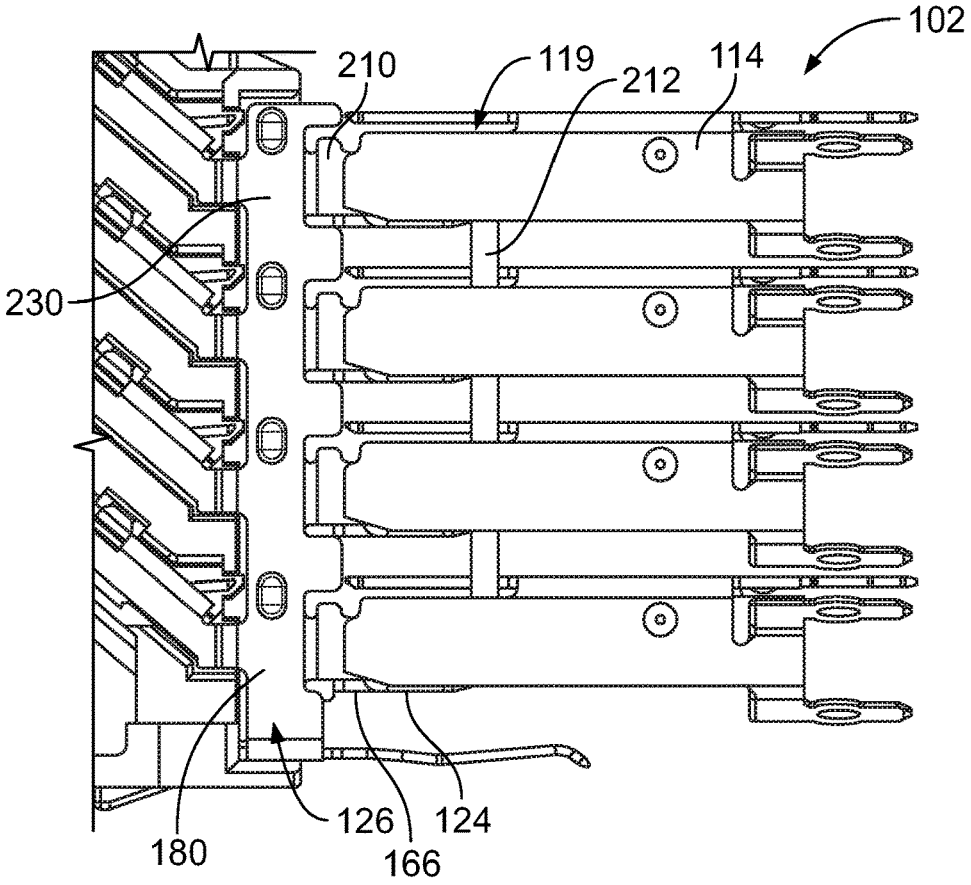
FIG. 8 is a side view of a portion of the electrical connector in accordance with an exemplary embodiment.

FIG. 6 is a perspective view of a portion of the electrical connector 102 in accordance with an exemplary embodiment showing header ground shields 114 mated with the shield structure 126. FIG. 7 is a top view of a portion of the electrical connector 102 in accordance with an exemplary embodiment showing header ground shields 114 mated with the shield structure 126. FIG. 8 is a side view of a portion of the electrical connector 102 in accordance with an exemplary embodiment showing header ground shields 114 mated with the shield structure 126. When assembled, the ground shields 180, 182 provide electrical shielding for the mating portions 166 of the signal contacts 124. The mating beams 210, 310 are configured to be electrically connected to the corresponding header ground shields 114, such as to the end walls 115, 116 of the corresponding header ground shields 114.

The tie bars 212, 312 (FIG. 4) extend between the mating beams 210, 310. In an exemplary embodiment, the slots 119 are formed in the header ground shields 114 to receive the tie bars 212, 312. The tie bars 212, 312 passed through corresponding slots 119 between the mating beams 210, 310. In the illustrated embodiment, the tie bars 212, 312 are located proximate to the distal ends 258, 358 of the mating beams 310. The tie bars 212, 312 are located forward of the ground pads 230, 330 a distance 260 such that the tie bars 212, 312 are located forward of the tips 118 of the header ground shields 114. The tips 118 of the header ground shields 114 are located proximate to the ground pads 230, 330 when mated to the electrical connector 102. The mating beams 310 extend forward from the ground pads 230, 330 into the interior of the header ground shields 114 along the mating portions 166 of the signal contacts 124. The mating interfaces 254, 256, 354, 356 may be generally aligned with the mating interface of the mating portions 166. The mating beams 210, 310 and the tie bars 212, 312 are configured to be located interior of the end walls 115, 116 of the header ground shields 114 for interfacing with the header ground shields 114.

The tie bars 212, 312 define tie bar electrical paths between the mating beams 210, 310 independent of the ground pad electrical paths defined between the mating beams 210, 310 by the ground pads 230, 330. The tie bar electrical paths are independent of header ground shield electrical paths defined by the header ground shields 114. The tie bar electrical paths create additional electrical paths in addition to the ground pad electrical paths and the header ground shield electrical paths located forward of the ground pad electrical paths. The shield structure electrically commons the tie bar electrical paths with the ground pad electrical paths and with the header ground shield electrical paths.

Figure 9:
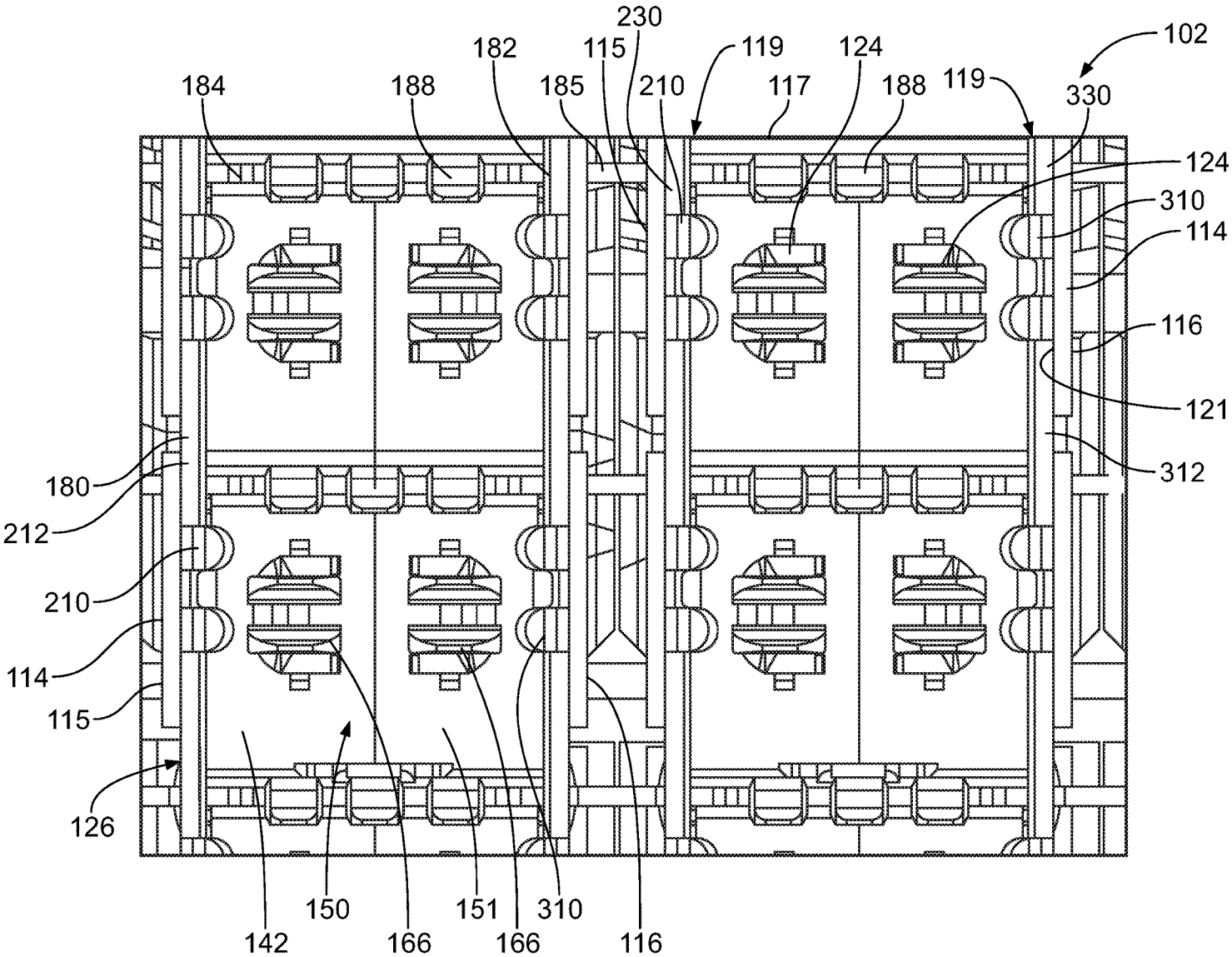
FIG. 9 is a front view of the mating interface of the electrical connector in accordance with an exemplary embodiment.

FIG. 9 is a front view of the mating interface of the electrical connector 102 showing the header ground shields 114 relative to the shield structure 126 in accordance with an exemplary embodiment. The first and second ground shields 180, 182 are provided along the right and left sides of the pairs of signal contacts 124. The ground blades 184 are shown above and below the pairs of signal contacts 124. The main body 185 of the ground blades 184 extends horizontally above the shield pockets surrounding the corresponding pairs of signal contacts 124. The first and second ground pads 230, 330 of the first and second ground shields 180, 182 extend vertically along the right and left sides of the shield pockets surrounding the corresponding pairs of signal contacts 124. The mating portions 188 of the ground blades 184 are aligned vertically above and/or below the corresponding pairs of signal contacts 124. The mating beams 210, 310 of the first and second ground shields 180, 182 are horizontally aligned in the row with the corresponding pairs of signal contacts 124. The tie bars 212, 312 extend between the mating beams 210, 310, respectively.

The header ground shields 114 are coupled to the shield structure 126. The mating portions 188 engage the header ground shields 114. The mating beams 210, 310 engage the header ground shields 114. The tie bars 212, 312 are electrically connected to the header ground shields 114. Optionally the tie bars 212, 312 may engage the header ground shields 114. The mating portions 188, the mating beams 210, 310 and the tie bars 212, 312 are spring biased against corresponding surfaces of the walls of the header ground shields 114.

The mating portions 188 of the ground blade 184 engage the center wall 117, such as the interior surface 121 of the center wall 117. The mating beams 210 of the first ground shield 180 engage the first end wall 115, such as the interior surface 121 of the first end wall 115. The mating beams 310 of the second ground shield 182 engage the second end wall 116, such as the interior surface 121 of the second end wall 116. The tie bars 212 of the first ground shield 180 extend through the slots 119 in the header ground shield 114. The tie bars 312 of the second ground shield 182 extend through the slots 119 in the header ground shield 114.

The end walls 115, 116 and the center wall 117 of the ground shield 114 form continuous shield walls around three sides of the shield pocket for the corresponding pair of signal contacts 124. The center wall 117 of the header ground shield 114 below the shield pocket forms a continuous wall around the fourth side of the shield pocket. Beyond the tip 118 of the header ground shield 114, the main body 185 of the ground blade 184 and the first and second ground pads 230, 330 of the first and second ground shields 180, 182 form continuous walls around all four sides of the pair of signal contacts at the front 151 of the dielectric holder 142. The tie bars 212, 312 define tie bar electrical paths between the mating beams 210, 310, such as proximate to distal ends of the mating beams 210, 310. The shield structure 126 and the header ground shields 114 provide effective electrical shielding for the pairs of signal contacts 124. The mating portions 166 are thus electrically shielded at the mating zone. The circumferential shielding is provided above, below and along opposite sides of each pair of signal contacts 124 at the mating end 150 of the dielectric holder 142. The circumferential shielding not only extends along the length of the transition portions 170 of the signal contacts 124, but is also located immediately forward of the dielectric holder 142, such as between the header ground shields 114 and the dielectric holder 142.

The stamped and formed first and second ground shields 180, 182 and the ground blade 184 are cost effective to manufacture, as compared to conventional plated plastic conductive holders. The stamped and formed first and second ground shields 180, 182 and the ground blade 184 provide electrical shielding in all directions for each pair-in-row pair of signal contacts 124, as compared to conventional ground shields that only extend along the sides of the signal contacts and not above or below the pair of signal contacts.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector for mating with a header connector having header signal contacts and header ground shields providing electrical shielding for the header signal contacts, the electrical connector comprising:

a front housing having a front and a rear, the front housing having a cavity at the rear, the front configured to be mated with the header connector;

a contact module received in the cavity, the contact module having a frame assembly including an array of signal contacts and a dielectric holder holding the array of signal contacts, each signal contact having a mating end and a terminating end, the mating end extending into the front housing for mating with the corresponding header signal contact of the header connector, the terminating end extending from the dielectric holder for termination to a circuit board; and a ground shield coupled to the dielectric holder, the ground shield providing electrical shielding for the signal contacts, the ground shield having a mating end and a terminating end configured to be terminated to the circuit board, the ground shield having a ground pad at the mating end, the ground shield having mating beams extending forward from the ground pad to distal ends for mating with corresponding header ground shields, and the ground shield having tie bars extending between corresponding mating beams proximate to the distal ends of the mating beams, the tie bars being spaced apart remote from the ground pad.

2. The electrical connector of claim 1, wherein the ground pad ties each of the mating beams together to physically hold relative positions of each of the mating beams together.

3. The electrical connector of claim 1, wherein the mating beams extend interior of end walls of the header ground shields to engage interior surfaces of the end walls and the tie bars extend through slots in the header ground shields between the corresponding mating beams.

4. The electrical connector of claim 1, wherein the tie bars are independently movable relative to each other.

5. The electrical connector of claim 1, wherein each mating beam includes an upper beam member and a lower beam member defining different points of contact with the same header ground shield, the tie bars extending between an upper beam member of one mating beam and the lower beam member of another mating beam.

6. The electrical connector of claim 1, wherein the tie bars are located forward of the ground pad a distance such that the tie bars are configured to be located forward of tips of the header ground shields.

7. The electrical connector of claim 1, wherein the tie bars are configured to be located interior of end walls of the header ground shields and extend through slots formed in the header ground shields between the end walls and corresponding center walls of the header ground shields.

8. The electrical connector of claim 1, wherein the ground pad, the mating beams and the tie bars are an integral, unitary monolithic body being electrically commoned with each of the header ground shields.

9. An electrical connector for mating with a header connector having header signal contacts and header ground shields extending to tips and providing electrical shielding for the header signal contacts, the electrical connector comprising:

a front housing having a front and a rear, the front housing having a cavity at the rear, the front configured to be mated with the header connector;

a contact module received in the cavity, the contact module having a frame assembly including an array of signal contacts and a dielectric holder holding the array of signal contacts, each signal contact having a mating end and a terminating end, the mating end extending into the front housing for mating with the corresponding header signal contact of the header connector, the terminating end extending from the dielectric holder for termination to a circuit board; and a ground shield coupled to the dielectric holder, the ground shield providing electrical shielding for the signal contacts, the ground shield having a mating end and a terminating end configured to be terminated to the circuit board, the ground shield having a ground pad at the mating end, the ground shield having mating beams extending forward from the ground pad to distal ends for mating with corresponding header ground shields forward of the tips of the corresponding header ground shields, and the ground shield having tie bars extending between corresponding mating beams proximate to the distal ends, the tie bars being positioned forward of the tips of the corresponding header ground shields.

10. The electrical connector of claim 9, wherein the ground pad ties each of the mating beams together to physically hold relative positions of each of the mating beams together.

11. The electrical connector of claim 9, wherein the mating beams extend interior of end walls of the header ground shields to engage interior surfaces of the end walls and the tie bars extend through slots in the header ground shields between the corresponding mating beams.

12. The electrical connector of claim 9, wherein the mating beams extend to distal ends, the tie bars being positioned proximate to the distal ends of the mating beams.

13. The electrical connector of claim 9, wherein the tie bars are independently movable relative to each other.

14. The electrical connector of claim 9, wherein each mating beam includes an upper beam member and a lower beam member defining different points of contact with the same header ground shield, the tie bars extending between an upper beam member of one mating beam and the lower beam member of another mating beam.

15. The electrical connector of claim 9, wherein the tie bars are located forward of the ground pad a distance such that the tie bars are configured to be located forward of the tips of the header ground shields.

16. The electrical connector of claim 9, wherein the tie bars are configured to be located interior of end walls of the header ground shields and extend through slots formed in the header ground shields between the end walls and corresponding center walls of the header ground shields.

17. The electrical connector of claim 9, wherein the ground pad, the mating beams and the tie bars are an integral, unitary monolithic body being electrically commoned with each of the header ground shields.

18. An electrical connector for mating with a header connector having header signal contacts and header ground shields providing electrical shielding for the header signal contacts, the electrical connector comprising:

a front housing having a front and a rear, the front housing having a cavity at the rear, the front configured to be mated with the header connector;

a contact module received in the cavity, the contact module having a frame assembly including an array of signal contacts and a dielectric holder holding the array of signal contacts, each signal contact having a mating end and a terminating end, the mating end extending into the front housing for mating with the corresponding header signal contact of the header connector, the terminating end extending from the dielectric holder for termination to a circuit board; and a ground shield coupled to the dielectric holder, the ground shield providing electrical shielding for the signal contacts, the ground shield having a mating end and a terminating end configured to be terminated to the circuit board, the ground shield having a ground pad at the mating end, the ground shield having mating beams extending forward from the ground pad for mating with corresponding header ground shields, and the ground shield having tie bars extending between corresponding mating beams, the tie bars defining tie bar electrical paths between the mating beams independent of a ground pad electrical path defined between the mating beams by the ground pad and independent of electrical paths defined by the header ground shields.

19. The electrical connector of claim 18, wherein the ground pad, the mating beams and the tie bars are an integral, unitary monolithic body being electrically commoned with each of the header ground shields.

20. The electrical connector of claim 18, wherein the mating beams extend to distal ends, the tie bars being positioned proximate to the distal ends of the mating beams.

* * * * *